US007808469B2

(12) United States Patent
Furuhashi et al.

(10) Patent No.: US 7,808,469 B2
(45) **Date of Patent: *Oct. 5, 2010**

(54) LIQUID CRYSTAL DISPLAY CONTROL DEVICE

(75) Inventors: Tsutomu Furuhashi, Yokohama (JP); Takeshi Maeda, Yokosuka (JP); Atsuhiro Higa, Yokohama (JP); Hisayuki Ohhara, Owariasahi (JP); Hiroshi Kurihara, Chiba-ken (JP); Naruhiko Kasai, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 854 days.

This patent is subject to a terminal disclaimer.

(21) Appl. No.: 11/713,729

(22) Filed: Mar. 5, 2007

(65) Prior Publication Data

US 2007/0164968 A1 Jul. 19, 2007

Related U.S. Application Data

(63) Continuation of application No. 11/407,976, filed on Apr. 21, 2006, now Pat. No. 7,202,848, which is a continuation of application No. 10/633,512, filed on Aug. 5, 2003, now Pat. No. 7,053,877, which is a continuation of application No. 09/928,413, filed on Aug. 14, 2001, now Pat. No. 6,628,260, which is a continuation of application No. 09/525,011, filed on Mar. 14, 2000, now Pat. No. 6,295,045, which is a continuation of application No. 09/294,432, filed on Apr. 20, 1999, now Pat. No. 6,121,947, which is a continuation of application No. 08/770,373, filed on Nov. 29, 1996, now Pat. No. 5,909,205.

(30) Foreign Application Priority Data

Nov. 30, 1995 (JP) ..... 7-312483

(51) Int. Cl.
*G09G 3/36* (2006.01)

(52) U.S. Cl. ..... 345/98; 345/698; 345/99; 345/213

(58) Field of Classification Search ..... 345/1.1–1.3, 345/2.1–2.3, 3.1–3.4, 87, 98–100, 213, 534, 345/556, 560, 563, 660, 671, 698, 699, 204
See application file for complete search history.

(56) References Cited

U.S. PATENT DOCUMENTS 4,481,511 A 11/1984 Hammura et al.

(Continued)

FOREIGN PATENT DOCUMENTS

EP 502600 A2 9/1992

(Continued)

*Primary Examiner*—Amara Mengistu
*Assistant Examiner*—Dmitriy Bolotin
(74) *Attorney, Agent, or Firm*—Brundidge & Stanger, P.C.

(57) ABSTRACT

There is provided a liquid crystal display control device which can display pictures in a magnification mode by using only a memory having low-speed access and a low storage capacity. When a video signal has intermediate resolution or less, the enlargement processing is performed by a frame memory, a line memory and an enlargement processing control circuit. If the input operation and the output operation to and from the frame memory are synchronized with each other, it is sufficient for the frame memory to have a storage capacity of two lines. When the video signal has the same high resolution as a liquid crystal display panel, the video signal is output through a gate circuit to a display timing generating circuit, and it is displayed in a through mode. In this case, no processing is performed by the frame memory or the like.

39 Claims, 11 Drawing Sheets

U.S. PATENT DOCUMENTS

| | | | | |
|---|---|---|---|---|
| 4,771,279 | A | | 9/1988 | Hannah |
| 4,845,661 | A | | 7/1989 | Shimada |
| 4,935,731 | A | | 6/1990 | Takebe et al. |
| 4,990,904 | A | | 2/1991 | Zenda |
| 5,016,193 | A | | 5/1991 | Stone et al. |
| 5,061,920 | A | | 10/1991 | Nelson |
| 5,111,190 | A | | 5/1992 | Zenda |
| 5,138,305 | A | | 8/1992 | Tomiyasu |
| 5,162,786 | A | | 11/1992 | Fukuda |
| 5,289,173 | A | | 2/1994 | Numao |
| 5,351,064 | A | | 9/1994 | Zenda |
| 5,406,308 | A | | 4/1995 | Shiki |
| 5,430,457 | A | | 7/1995 | Zenda |
| 5,448,259 | A | | 9/1995 | Hidaka |
| 5,469,223 | A | | 11/1995 | Kimura |
| 5,475,437 | A | | 12/1995 | Song |
| 5,508,714 | A | | 4/1996 | Zenda |
| 5,517,603 | A | | 5/1996 | Kelley et al. |
| 5,528,305 | A | | 6/1996 | Kim |
| 5,532,716 | A | | 7/1996 | Sano |
| 5,534,934 | A | | 7/1996 | Katsumata et al. |
| 5,638,088 | A | | 6/1997 | Mano et al. |
| 5,644,329 | A | | 7/1997 | Asari et al. |
| 5,648,790 | A | | 7/1997 | Lee |
| 5,689,280 | A | | 11/1997 | Asari et al. |
| 5,699,074 | A | | 12/1997 | Sutherland et al. |
| 5,706,034 | A | | 1/1998 | Katsura et al. |
| 5,719,594 | A | | 2/1998 | Potu |
| 5,739,867 | A | | 4/1998 | Eglit |
| 5,742,261 | A | | 4/1998 | Yuki et al. |
| 5,777,687 | A | | 7/1998 | De Lange |
| 5,784,037 | A | | 7/1998 | Inoue |
| 5,815,128 | A | | 9/1998 | Hoshino et al. |
| 5,844,539 | A | | 12/1998 | Kitagawa |
| 5,874,937 | A | | 2/1999 | Kesatoshi |
| 5,883,609 | A | | 3/1999 | Asada et al. |
| 5,909,205 | A | | 6/1999 | Furuhashi et al. |
| 6,014,125 | A | * | 1/2000 | Herbert ..... 345/660 |
| 6,067,071 | A | | 5/2000 | Kotha et al. |
| 6,115,020 | A | * | 9/2000 | Taguchi et al. ..... 345/99 |
| 6,118,429 | A | | 9/2000 | Kasai et al. |
| 6,121,947 | A | | 9/2000 | Furuhashi et al. |
| 6,295,045 | B1 | | 9/2001 | Furuhashi et al. |
| 6,628,260 | B2 | | 9/2003 | Furuhashi et al. |
| 7,053,877 | B2 | | 5/2006 | Furuhashi et al. |

FOREIGN PATENT DOCUMENTS

| | | |
|---|---|---|
| JP | 1-152497 | 6/1989 |
| JP | 1-194784 | 8/1989 |
| JP | 2-1889 | 1/1990 |
| JP | 2-9277 | 1/1990 |
| JP | 02-199498 | 8/1990 |
| JP | 03-132789 | 6/1991 |
| JP | 04-12393 | 1/1992 |
| JP | 4-125586 | 4/1992 |
| JP | 4-331981 | 11/1992 |
| JP | 5-119749 | 5/1993 |
| JP | 5-150219 | 6/1993 |
| JP | 5-35209 | 12/1993 |
| JP | 5-323899 | 12/1993 |
| JP | 6-276432 | 9/1994 |
| JP | 07-5838 | 1/1995 |
| JP | 7-49662 | 2/1995 |
| JP | 7-104706 | 4/1995 |
| JP | 7-104710 | 4/1995 |
| JP | 07-168542 | 7/1995 |
| JP | 7-199855 | 8/1995 |
| JP | 7-261732 | 10/1995 |
| JP | 08-122747 | 5/1996 |

* cited by examiner

GRADATION INTEGRATION METHOD (2→3)

SIMPLE ENLARGEMENT METHOD (2→3)

PORTION OF BROKEN LINE OF FRSTR-N, FRCLK IS PRODUCED AT ONLY FIRST "H" READ TIME

TIMING CHART FOR HORIZONTAL DIRECTION MEMORY ACCESS OF GRADATION INTEGRATION METHOD(2→3)

TIMING CHART FOR VERTICAL DIRECTION MEMORY ACCESS OF GRADATION INTEGRATION METHOD(2→3)

PORTION OF BROKEN LINE OF FRSTR-N, FRCLK IS PRODUCED AT ONLY FIRST "H" READ TIME

TIMING CHART FOR HORIZONTAL DIRECTION MEMORY ACCESS OF GRADATION INTEGRATION METHOD(4→5)

TIMING CHART FOR VERTICAL DIRECTION MEMORY ACCESS OF GRADATION INTEGRATION METHOD(4→5)

PORTION OF BROKEN LINE OF FRSTR-N, FRCLK IS PRODUCED AT ONLY FIRST "H" READ TIME

TIMING CHART FOR HORIZONTAL DIRECTION MEMORY ACCESS OF THROUGH MODE W ITH MEMORY

TIMING CHART FOR VERTICAL DIRECTION MEMORY ACCESS OF THROUGH MODE WITH MEMORY

PORTION OF BROKEN LINE OF FRSTR-N, FRCLK IS PRODUCED AT ONLY FIRST "H" READ TIME

TIMING CHART FOR HORIZONTAL DIRECTION MEMORY ACCESS OF SIMPLE ENLARGEMENT(2→3)

TIMING CHART FOR VERTICAL DIRECTION MEMORY ACCESS OF SIMPLE ENLARGEMENT(2→3)

PORTION OF BROKEN LINE OF FRSTR-N, FRCLK IS PRODUCED AT ONLY FIRST "H" READ TIME

TIMING CHART FOR HORIZONTAL DIRECTION MEMORY ACCESS OF SIMPLE ENLARGEMENT(4→5)

TIMING CHART FOR VERTICAL DIRECTION MEMORY ACCESS OF SIMPLE ENLARGEMENT(4→5)

LIQUID CRYSTAL DISPLAY CONTROL DEVICE

This is a continuation application of U.S. Ser. No. 11/407,976 filed Apr. 21, 2006, now U.S. Pat. No. 7,202,848, which is a continuation of U.S. Ser. No. 10/633,512, filed Aug. 5, 2003, now U.S. Pat. No. 7,053,877, which is a continuation of U.S. Ser. No. 09/928,413, filed Aug. 14, 2001, now U.S. Pat. No. 6,628,260, which is a continuation application of U.S. Ser. No. 09/525,011, filed Mar. 14, 2000, now U.S. Pat. No. 6,295,045, which is a continuation application of U.S. Ser. No. 09/294,432, filed Apr. 20, 1999, now U.S. Pat. No. 6,121,947, which is a continuation application of U.S. Ser. No. 08/770,373, filed Nov. 29, 1996, now U.S. Pat. No. 5,909,205. This application is also related to U.S. Ser. No. 09/500,237, filed Feb. 8, 2000, now U.S. Pat. No. 6,219,020, and U.S. Ser. No. 08/891,751, filed Jul. 14, 1997, now U.S. Pat. No. 6,088,014.

BACKGROUND OF THE INVENTION

1. Field of the Invention

The present invention relates to a liquid crystal display control device which is used to reduce the storage capacity of a storage element required when an image formed from video signals transmitted from a personal computer or the like is displayed in an enlarged mode on a liquid crystal display device.

2. Description of Related Art

A technique as disclosed in Japanese Laid-open Patent Application No. Hei-4-12393 has been known as a liquid crystal display control device for displaying video information from a personal computer or the like while enlarging the video information. In this technique, a video signal transmitted from a personal computer or the like is temporarily stored in a frame memory, and the stored data are read out at a timing which is compatible with a liquid crystal display operation. This technique will be described in detail with reference to FIGS. 12 and 13.

FIG. 12 is a block diagram showing a control circuit in a liquid crystal display device disclosed in Japanese Laid-open Patent Application No. Hei-4-12393. In FIG. 12, reference numeral 1101 represents a video signal from the personal computer or the like, and reference numeral 1102 represents a synchronous signal. Reference numeral 1103 represents a horizontal/vertical timing and basic clock generating circuit, reference numeral 1104 represents an automatic input signal discriminant circuit, reference numeral 1105 represents a frame memory data generating and frame memory write-in circuit, reference numeral 1106 represents a frame memory circuit which comprises a field memory and a line buffer, reference numeral 1107 represents a frame memory read-out and display data generating circuit, reference numeral 1108 represents an enlarged display control circuit, reference numeral 1109 represents a liquid crystal display circuit, and reference numeral 1110 represents a liquid crystal display unit.

FIG. 13 is a block diagram showing the details of the frame memory circuit 1106 shown in FIG. 12. In FIG. 13, reference numeral 1201 represents a field memory, reference numeral 1202 represents a line buffer and reference numeral 1203 represents a read-out data select circuit.

In FIGS. 12 and 13, the horizontal/vertical timing and basic clock generating circuit 1103 generates a horizontal timing signal, a vertical timing signal and a basic clock signal CK1 for controlling the operation of the frame memory data generating and frame memory write-in circuit 1105 on the basis of the horizontal and vertical synchronous signals 1102 for driving a CRT display device which are input from the personal computer or the like.

The frame memory data generating and frame memory write-in circuit 1105 generates a control signal WRCT (write clock signal SWCK, write enable signal WE, reset write signal RSTW) on the basis of the basic clock signal CK1, and outputs the control signal WRCT to the field memory 1201 (see FIG. 13). Further, using the frame memory data generating and frame memory write-in circuit 1105, memory data Din of one frame which are generated on the basis of the video signal 1101 input from the personal computer or the like are successively written and temporarily stored into the field memory 1201.

Furthermore, the frame memory read-out and display data generating circuit 1107 generates a control signal RDCT on the basis of the clock signal CK2 for driving the liquid crystal display, generated by the liquid crystal display circuit 1109, and the control signal generated by the enlarged display control circuit 1108, and then outputs the control signal RDCT to the frame memory circuit 1106. The clock signal CK2 for driving the liquid crystal display is set to have a longer period than the basic clock signal CK1.

The control signal RDCT comprises a read clock signal SRCK, a read reset signal RSTR, a write clock signal WCK, a reset write signal RSTWN, a read clock signal RCK, a reset read signal RSTRN and a data selection signal SELDT. Of these signals, the read clock signal SRCK and the read reset signal RSTR are supplied to the field memory 1201. The write clock signal WCK, the reset write signal RSTWN, the read clock signal RCD and the reset read signal RSTRN are supplied to the line buffer 1202 of the frame memory circuit 1106. The data selection signal SELDT are supplied to the read-out data select circuit 1203 of the frame memory 1106.

The read-out data select circuit 1203 selects any one of an output data D1 of the field memory 1201 and an output data D2 of the line buffer 1202, and outputs the selected data as frame memory read-out data data.

On the basis of the data data, the frame memory read-out and display data generating circuit 1107 as described above generates serial liquid crystal display data which are compatible with the liquid crystal display unit 1110.

On the basis of the clock signal CK2 for driving the liquid crystal display, the liquid crystal display circuit 1109 generates a liquid crystal display driving signal, a data shift clock signal and an alternating signal which are compatible with the format of the liquid crystal display unit 1110.

The liquid crystal display unit 1110 displays a predetermined image on the basis of the liquid crystal display data output from the frame memory read-out and display data generating circuit 1107 and the signal output from the liquid crystal display circuit 1109.

The enlarged display control circuit 1108 judges whether an instruction for enlarging a part of the frame is made by an operator. If it is judged that the enlarge display instruction is made, it controls the frame memory data generating and frame memory write-in circuit 1105 and the frame memory read-out and display data generating circuit 1107 in accordance with information on an indicated magnification rate, an enlarging area, etc.

Further, the automatic input signal discriminant circuit 1104 discriminates, on the basis of the synchronous signal 1102, an input video signal which is varied in accordance with, for example, the type of personal computer, and it controls the horizontal/vertical timing and basic clock generating circuit 1103 in accordance with the discrimination result.

According to the above-described technique, the enlargement processing can be performed. However, since the input and output operations of the video signals are perfectly asynchronously controlled by using a field memory, the field memory must have a storage capacity for storing video information of at least one frame. The memory capacity in which the video information of one frame can be stored is not so small in the present memory technique.

Furthermore, in the conventional technique as described above, all video signals are temporarily stored in the frame memory circuit 1106 so as to keep the read-out timing to the liquid crystal display unit constant at all times. Therefore, when a high-resolution video signal is input, a field memory to which high-speed access can be made is required irrespective of use and non-use of the enlargement processing. The use of a memory which can be accessed at high speed is a factor preventing cost reduction of the display device, because such a memory is expensive.

SUMMARY OF THE INVENTION

An object of the present invention is to provide a liquid crystal display control device which performs enlargement processing while suppressing increase in memory capacity.

Another object of the present invention is to provide a liquid crystal display control device which enables application to high-resolution video signals irrespective of use of a memory having a low access speed (i.e., a cheap memory).

A further object of the present invention is to provide a liquid crystal display control device which can freely select any image quality and any cost in accordance with a user's request.

In order to attain the above objects, according to a first aspect of the present invention, a liquid crystal display control device for receiving an input video signal and outputting display data corresponding to the video signal to a liquid crystal display panel to display the picture of the display data on the liquid crystal display panel, comprises a storage element for storing the input video signal, and memory control means for controlling the storage element to store the input video signal at the timing corresponding to the input timing of the video signal and to read out the video signal from the storage element at the timing corresponding to the output timing of the display data to the liquid crystal display panel.

Now, the operation of the first aspect of the present invention will be described. The memory control means controls the video signal input from a personal computer or the like to be stored into the storage element at the timing corresponding to the input timing of the video signal. In addition, at the same time, the memory control means controls the video signal to be read out from the storage element at the timing corresponding to the output timing of the display data to the liquid crystal display panel. Accordingly, the storage element may be designed to have a storage capacity of only two lines.

According to a second aspect of the present invention, a liquid crystal display control device for receiving an input video signal and displaying a picture corresponding to the video signal on a liquid crystal display, comprises a frame memory for storing the input video signal, a line memory for storing a video signal read out from the frame memory, memory control means for controlling the data write-in and read-out operation of the video signal in and from the frame memory and the line memory, and a calculation processing circuit for performing predetermined processing on the video signal read out from the frame memory and the video signal read out from the line memory, and then outputting the processed video signals to the liquid crystal display panel, wherein the memory control means synchronizes the read-out of the video signal from the frame memory and the write-in of the video signal into the frame memory every time interval which is determined separately.

In this case, it is preferable that the frame memory has a storage capacity corresponding to two lines of the input video signal.

Now the operation of the second aspect of the present invention will be described. The memory control means controls the video signal input from a personal computer or the like to be read out from the frame memory. In this case, the memory control means causes the read-out operation to be synchronized to the write-in operation of the video signal into the frame memory every time interval which is determined separately (the synchronization does not used to be established at all times). Accordingly, it is sufficient for the frame memory to have a storage capacity of only two lines.

The calculation processing circuit performs predetermined processing (for example, enlargement processing) on the video signal read out from the frame memory and the video signal read out from the line memory, and then outputs the processed signals to the liquid crystal display panel. When the predetermined processing is enlargement/reduction processing, the separately-determined time interval is set in accordance with the enlargement/reduction rate.

If the frame memory and the line memory are constructed by a single kind of storage element, this is convenient from the standpoint of the simplicity of the device. According to the present invention, it is necessary to control the input and output operations asynchronously and to perform the input and output operations at the same time. Accordingly, a FIFO type line buffer is most preferable as a storage element being used in this embodiment (the same is true for other embodiments). If the input video signal is processed in two-parallel mode, the frame memory may be constructed using a FIFO type line memory having a storage capacity of one line in an expansion direction. With this construction, the data amount which can be processed within a unit time is doubled, and thus the data processing speed is enhanced.

According to a third aspect of the present invention, a liquid crystal display control device for receiving an input video signal and displaying a picture corresponding to the video signal on a liquid crystal display panel, comprises a frame memory for storing the input video signal, a memory mount portion for being capable of mounting thereon a line memory which is separately provided to store a video signal read out from the frame memory, memory control means for controlling an input/output operation of the video signal to/from the frame memory and an input/output operation of the video signal to/from the line memory mounted on the memory mount portion, and a calculation processing circuit for performing predetermined processing on the video signal read out from the frame memory or the video signals read out from both the frame memory and the line memory mounted on the memory mount portion, and then outputting the processed signal(s) to the liquid crystal display panel.

In this case, the calculation circuit is preferably designed to change its processing content in accordance with the presence or absence of the line memory (i.e., the situation where the line memory is provided or not). The memory mount portion is preferably designed so that a memory card can be mounted on the memory mount portion. Further, the processing which is performed by the calculation processing circuit may contain the enlargement/reduction processing of the picture corresponding to the video signal.

Now the operation of the third aspect of the present invention will be described. The memory control means controls the input/output of the video signal to/from the frame memory, the line memory mounted the memory mount portion (it may be formed as a memory card). The calculation processing circuit performs the predetermined processing (for example, the enlargement/reduction processing of the picture corresponding to the video signal) on the video signal which is read out from the frame memory and the line memory mounted on the memory mount portion, and then outputs the processed signal to the liquid crystal panel. The calculation processing circuit changes its processing content in accordance with the presence or absence of the line memory. Accordingly, the system can be constructed so as to meet the image quality which is desired by a user and at a permissible cost in accordance with the situation where the line memory is provided or not.

According to a fourth aspect of the present invention, a liquid crystal display control device for receiving an input video signal and displaying the picture corresponding to the video signal on the liquid crystal display panel, comprises resolution judgment means for judging the resolution of the input video signal, first processing means for directly outputting the video signal as a bypass video signal, second processing means for performing predetermined processing on the input video signal and then outputting the signal as a processed signal, and timing adjusting means for adjusting an output timing of the signal output from the first processing means or the second processing means to the liquid crystal display panel, wherein the first processing means outputs the bypass video signal when a resolution of the video signal which is judged by the resolution judgment means is coincident with the resolution of the liquid crystal display panel, and stops the output of the bypass video signal when the resolution of the video signal which is judged by the resolution judgment means is not coincident with the resolution of the liquid crystal display panel, and wherein the second processing means stops the output of the processed signal when the resolution of the video signal which is judged by the resolution judgment means is coincident with the resolution of the liquid crystal display panel, and outputs the processed signal when the resolution of the video signal which is judged by the resolution judgment means is not coincident with the resolution of the liquid crystal display panel.

In this case, the second processing means may perform the enlargement processing on the video signal.

Now the operation of the fourth aspect of the present invention will be described. The resolution judgment means judges the resolution of the input video signal. The first processing means and the second processing means change their processing operations in accordance with the resolution judgment results. That is, when the resolution of the video signal which is judged by the resolution judgment means is coincident with the resolution of the liquid crystal display panel, the first processing means outputs the bypass video signal. On the other hand, the second processing means stops the output of the processed signal. Conversely, when the resolution of the video signal which is judged by the resolution judgment means is not coincident with the resolution of the liquid crystal display panel, the second processing means performs the predetermined processing (for example, picture enlargement processing) on the input video signal, and then outputs the signal as a processed signal. On the other hand, the first processing means stops the output of the bypass video signal. The timing adjusting means adjusts the timing of the signal which is output from the first processing means or the second processing means, and then outputs the timing-adjusted signal to the liquid crystal display panel.

As described above, the processing means (or processing route) of video signals is switched in accordance with the resolution. Thus, means which is applicable to any resolution is not required to be used as an element constituting each processing means. For example, when the second processing means performs the enlargement processing or the like by using a frame memory or the like, the second processing means is not required to have the capability of processing the video signals of the same high resolution as the liquid crystal panel. Accordingly, a memory having a low access speed and a low price may be used as the frame memory of the second processing means.

As described above, according to the present invention, the enlargement display of video signals on the liquid crystal display panel can be performed by using a memory of low access speed and low price (for example, FIFO type line buffer).

Furthermore, an enlargement processing method can be freely selected in accordance with the presence or absence of a line memory. Therefore, a user can select any suitable device construction in accordance with an application, a cost and image quality requested by the user.

DETAILED DESCRIPTION OF THE PREFERRED EMBODIMENT

Preferred embodiments according to the present invention will be described hereunder with reference to the accompanying drawings.

Figure 1:
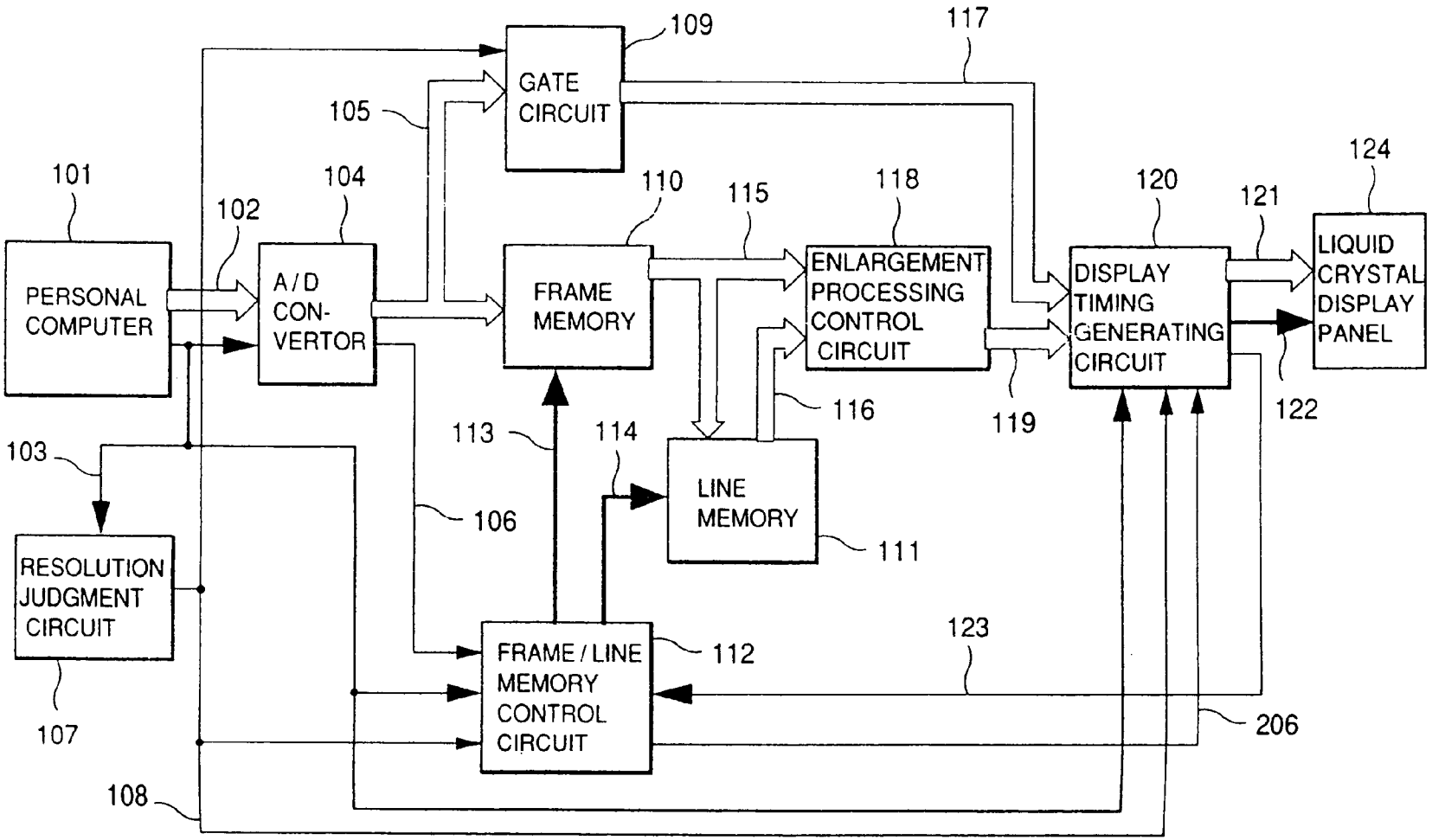
FIG. 1 is a block diagram showing the construction of a liquid crystal display control device according to a first embodiment of the present invention.

FIG. 1 shows a liquid crystal display control device according to a first embodiment of the present invention. As shown in FIG. 1, the liquid crystal display control device includes an A/D convertor 104, a resolution judgment circuit 107, a gate circuit 109, a frame memory 110, a line memory 111, a frame/line memory control circuit 112, an enlargement processing control circuit 118 and a display timing generating circuit 120. Needless to say, the liquid crystal display control device is used while connected to a personal computer 101 and a liquid crystal display panel 124. In the following embodiment, the liquid crystal display control device is assumed to be connected to the liquid crystal display panel 124 having high resolution (for example, 1024×768 dots).

The A/D convertor 104 digitizes an analog video signal 102 output from the personal computer 101, and then outputs the digitized signal as a digital video signal 105 to the frame memory 110 and the gate circuit 109. Likewise, it converts a synchronous signal 103 output from the personal computer 101 to a digital signal and then outputs the digital signal as a dot clock 106 to the frame/line memory control circuit 112. The dot clock 106 represents a conversion speed of the A/D convertor 104.

The resolution judgment circuit 107 judges the resolution of the video signal 102 on the basis of the synchronous signal 103. The resolution judgment circuit 107 outputs the judgment result as a resolution judgment result 108 to the gate circuit 109, the frame/line memory control circuit 112 and the display timing generating circuit 120.

The gate circuit 109 serves to perform bypass processing on the digital video signal 105. When the digital video signal 105 having the resolution which is coincident with the resolution of the liquid crystal display panel 124 is input to the gate circuit 109, the gate circuit 109 opens its gate to output the digital video signal 105 as bypass data 117 to the display timing generating circuit 120. When the digital video signal having the resolution which is not coincident with the resolution of the liquid crystal display panel 124 is input, the gate circuit 109 closes its gate to inhibit the video signal from passing therethrough. On the basis of the resolution judgment result 108 input from the resolution judgment circuit 107, the gate circuit 109 detects the resolution of the input video signal at this time.

The frame memory 110 is adapted to temporarily store the digital video signal 105. In this embodiment, a FIFO type line buffer memory having a storage capacity corresponding to two lines of the video signal 105 is used as the frame memory 110. The data which are temporarily stored in the frame memory 110 are output to the enlargement processing control circuit 118 and the line memory 111 as frame memory read data 115. The line memory 111 reads out the data stored in the frame memory 110 line by line and stores the read-out data therein to supply the data to the picture enlargement processing. The line memory 111 also has a capacity storage corresponding to two lines of the video signal 105. The data which are stored in the tine memory 111 are output as line memory read data 116 to the enlargement processing control circuit 118.

In this embodiment, the input/output of the frame memory 110 and the input/output of the line memory 111 are performed in synchronism with each other. Accordingly, no problem occurs even when the frame memory 110 has the storage capacity of only, two lines. This is one of the features of the present invention, and it will be described in detail later. The operation of the memories 110 and 111 is controlled by the frame memory control signal 113 and the line memory control signal 114 which are input from the frame/line memory control circuit 112.

The frame/line memory control circuit 112 serves to control the operation of the frame memory 110 and the line memory 111. Therefore, the frame/line memory control circuit 112 generates the frame memory control signal 113 and the line memory control signal 114 on the basis of the dot clock 106, the synchronous signal 103, the resolution judgment result 108 and a memory access reconciling signal 123, and outputs these signals to the frame memory 110 and the line memory 111. Further, it outputs a memory architecture decode signal 206 as described later to the display timing generating circuit 120.

The enlargement processing control circuit 118 performs the enlargement processing by using the frame memory read data 115 and the line memory read data 116, and then outputs the enlargement-processed result as a video signal 119 to the display timing generating circuit 120. The enlargement processing itself by the enlargement processing control circuit 118 and the line memory 111 is basically the same as the conventional technique described above.

The display timing generating circuit 120 serves to adjust the timing of each of the video signal 117 and the video signal 119 so as to meet the display timing of the liquid crystal display panel 124. After the timing adjustment, the display timing generating circuit 120 outputs these signals as a video signal 121 to the liquid crystal display panel 124. However, as described above, only one of the video signal 117 and the video signal 119 is input to the display timing generating circuit 120 in accordance with the video signal 105 which is input at that time, and both the signals are not input at the same time.

The timing adjustment operation of the display timing generating circuit 120 is also varied in accordance with the resolution judgment result 108 (i.e., the resolution of the video signal 105 which is input at that time). Further, the display timing generating circuit 120 generates a display timing signal 122 and the memory access reconciling signal 123 on the basis of the synchronous signal 103 and the resolution judgment result 108, and it outputs the display timing signal 122 to the liquid crystal display panel 124 while outputting the memory access reconciling signal 123 to the frame/line memory control circuit 112. The memory access reconciling signal 123 is the signal which is synchronous with the display timing of the liquid crystal display panel 124. The read-out of the data from the frame memory 110 as described above is performed in synchronism with the memory access reconciling signal 123. The display timing signal 122 and the memory access reconciling signal 123 are also varied in accordance with the resolution judgment result 108.

This embodiment is characterized in that the timing of the digital video signal 105 and the timing of the frame memory read data 115 are synchronized with each other. Further, it is also characterized in that when the resolution of the analog video signal 102 (digital video signal 105 ) is coincident with the resolution of the liquid crystal display panel 124, the display data are output as the bypass data 117 through the gate circuit 109. With these features, a FIFO type line buffer having a low access speed and a low capacity like the line memory 111 may be used as the frame memory 110.

Next, the operation of the liquid crystal display device according to this embodiment will be described with reference to FIG. 1.

The A/D convertor 104 converts the analog video signal 102 to the digital video signal 105. In parallel to this conversion processing, the resolution judgment circuit 107 performs the resolution judgment on the basis of the horizontal/vertical synchronous signal 103. Thereafter, the resolution judgment circuit 107 outputs the judgment result 108 to the gate circuit 109, the frame/line memory control circuit 112 and the display timing generating circuit 120.

The gate circuit 109, the frame/line memory control circuit 112 and the display timing generating circuit 120 change their operation contents in accordance with the resolution judgment result 108.

When the resolution of the video signal 105 is coincident with the resolution of the liquid crystal display panel 124, the gate circuit 109 opens its gate, and outputs the input digital video signal 105 as the bypass data 117 to the display timing generating circuit 120. The display timing generating circuit 120 adjusts the timing of the bypass data 117, and then outputs the adjusted data as display data 121 to the liquid crystal display panel 124. Further, in addition, the display timing generating circuit 120 outputs the synchronous signal 103 as a display timing signal 122 to the liquid crystal display panel 124. In this case (when the resolution of the video signal 105 is coincident with the resolution of the liquid crystal display panel 124), the frame/line memory control circuit 112 stops a memory access.

When the resolution of the digital video data 105 is lower than the resolution of the liquid crystal display panel 124, the gate circuit 109 closes its gate. Accordingly, no bypass data 117 is output. On the other hand, the frame/line memory control circuit 112 performs write/read control as described later on the frame memory 110 and the line memory 111. When the write/red control is performed, the digital video signal 105 is subjected to the enlargement processing or the like, and then output to the display timing generating circuit 120.

The write/read control will be hereunder described in detail.

When the write/read control is started by the frame/line memory control circuit 112, the digital video signal 105 is first written in the frame memory 110. The display data which are written in the frame memory 110 are read out in conformity to the memory access reconciling signal 123 (i.e., the display timing of the liquid crystal display panel 124), and output as frame memory read data 115 to the enlargement processing control circuit 118 and the line memory 111. In this case, the data read-out operation from the frame memory 110 is performed in synchronism with the data write-in operation into the frame memory 110 every predetermined time interval (which is determined in accordance with an enlargement rate (magnification)). Accordingly, no problem occurs even when the frame memory 110 has the storage capacity corresponding to only two lines.

The display data written in the line memory 111 are read out after a fixed delay time, and then output to the enlargement processing control circuit 118. The enlargement processing control circuit 118 performs the enlargement processing on the basis of the frame memory read data 115 and the line memory read data 116, and then outputs the enlargement-processed result as the video signal 119 to the display timing generating circuit 120. The display timing generating circuit 120 adjusts the timing of the video signal 119, and outputs the video signals after the timing adjustment as display data 121 to the liquid crystal display panel 124 together with the display timing signal 122. The display timing signal 122 is generated on the basis of the synchronous signal 103 and the synchronous signal which is generated in the display timing generating circuit 120, and then output to the liquid crystal display panel 124.

Next, the frame/line control circuit 112 and a memory access reconciling circuit 213 in the display timing generating circuit 120 shown in FIG. 1 will be described in detail with reference to FIG. 2.

The frame/line control circuit 112 includes an input video signal activating circuit 204, a memory architecture decode circuit 205, an enlargement calculation decode circuit 207, an input horizontal synchronous signal synchronizing circuit 209, an internal horizontal synchronous signal generating circuit 211, a memory access reconciling circuit 213, a frame memory write control circuit 214, a frame memory read control circuit 215, a line memory write control circuit 216 and a line memory read control circuit 217.

The memory architecture decode circuit 205 decodes a mode signal 201 which is input from the external of the frame/line memory control circuit 112, and then outputs the decode result as a decode signal 206. The decode signal 206 represents the memory architecture of the frame memory 110 and the line memory 111. Table 1 represents a decode corresponding list of he mode signal 201 (the relationship between the mode signal and the memory architecture).

TABLE 1

| | | MEMORY ARCHITECTURE | |
|---|---|---|---|
| MODE0 | MODE1 | FRAME MEMORY | LINE MEMORY |
| 0 | 0 | USED | USED |
| 0 | 0 | USED | UNUSED |
| 1 | 1 | UNUSED | UNUSED |

There are three memory architecture modes, namely a first mode in which both a frame memory and a line memory are provided, a second mode in which only a frame memory is provided, and a third mode in which neither a frame memory nor a line memory is provided. In this embodiment, both the frame memory 110 and the line memory 111 are provided (see FIG. 1). Therefore, the mode signal 201 is "MODE(1:0)=(0,0)".

The enlargement calculation decode circuit 207 decodes a calculation mode signal 203 representing an enlargement calculation mode, and outputs the decode result as a decode signal 208. The calculation mode signal 203 is input from the external of the frame/line memory control circuit 112. Table 2 shows a corresponding decode list of the calculation mode signal 203.

TABLE 2

| SCALE2 | SCALE1 | SCALE0 | CALCULATION MODE |
|---|---|---|---|
| 0 | 0 | 0 | THROUGH MODE WITHOUT MEMORY |
| 0 | 0 | 1 | THROUGH MODE WITH MEMORY |
| 0 | 1 | 0 | 2→3 (GRADATION INTEGRATION) |
| 0 | 1 | 1 | 2→3 (SIMPLE ENLARGEMENT) |
| 1 | 0 | 0 | 4→5 (GRADATION INTEGRATION) |
| 1 | 0 | 1 | 4→5 (SIMPLE ENLARGEMENT) |

The mode signal 201 and the calculation mode signal 203 are fixed level signals which are logically equal to "H" or "L".

Figure 3:
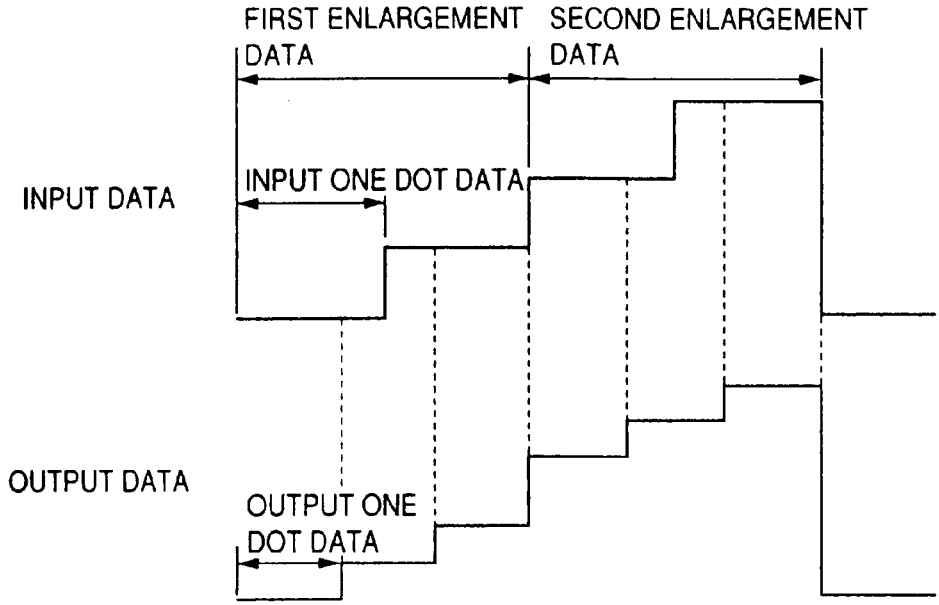
FIG. 3 is a diagram showing an enlargement processing system based on a gradation integration method.
Figure 4:
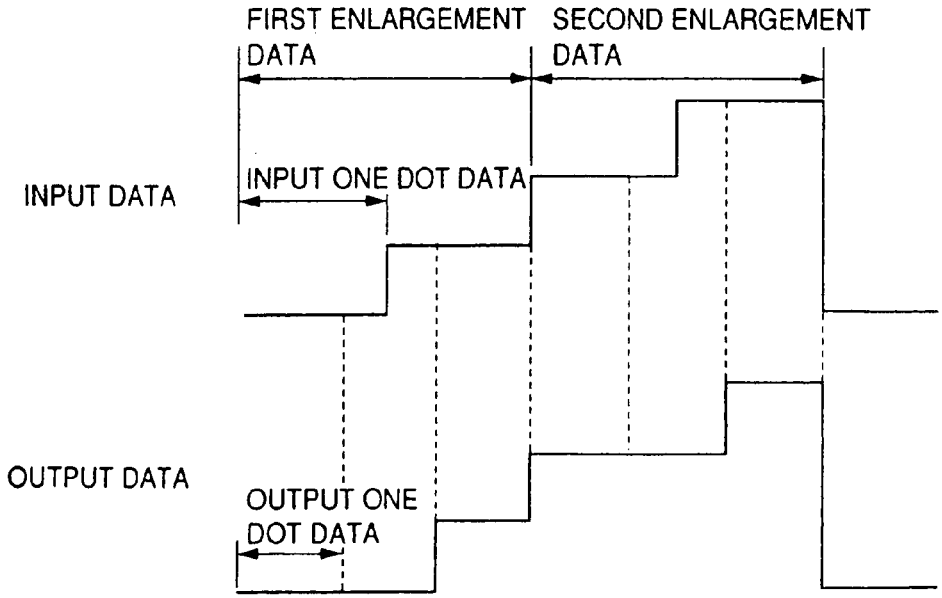
FIG. 4 is a diagram showing an enlargement processing system based on a simple enlargement method.

In this case, the following six modes are assumed to be provided as the calculation mode: a through mode (presence of memory/absence of memory), 2→3 enlargement (gradation integration method/simple enlargement method), and 4→5 enlargement (gradation integration method/simple enlargement method). The through mode is a mode in which a video signal having the resolution which can be displayed while enlarged is directly displayed in an input size while subjected to no enlargement processing. The gradation integration method is a system in which each dot is weighted with gradation and then subjected to predetermined calculation processing, and then the data thus obtained are matched to the dots of the liquid crystal display panel 124 to increase the number of dots (see FIG. 3). The simple enlargement method is a system in which some dots are displayed so as to correspond to two dots of the liquid crystal display panel 124 while the other dots are displayed so as to correspond to one dot of the liquid crystal display panel 124 (see FIG. 4).

The circuit construction shown in FIG. 1 is set to any one calculation mode of the through mode (in the presence of memory) "SCALE(2:0)=(0,0,1)", 2→3 enlargement (gradation integration method), "SCALE(2:0)=(0,1,0)", 4→5 enlargement (gradation integration method)"SCALE(2:0)=(1,0,0)". In this case, the enlargement size (magnification) is set to 2→3 (1.5 times) or 4→5 (1.25 times). However, these values are merely examples, and the enlargement size is not limited to these values. Any magnification rate may be set.

Table 3 shows an enlargement-size list in each input mode.

TABLE 3

| INPUT MODE | CONVERSION RATE | SIZE AFTER CONVERSION |
|---|---|---|
| 640*350 | 2→3 | 960*525 |
| 640*400 | 2→3 | 960*600 |
| 640*480 | 2→3 | 960*720 |
| 800*600 | 4→5 | 1000*750 |
| 1024*768 | THOUGH | 1024*768 |

In this case, the liquid crystal display panel 124 is assumed to have a high resolution of 1024×768 (XGAmode). Only the input mode of an intermediate resolution of 800×600 (SVGA) corresponds to the enlargement of 4→5 (1.25 times). The input modes of the other low resolutions correspond to the enlargement of 2→3 (1.5 times). The input mode having the same resolution (1024×768 (XGA)) as the liquid crystal display panel 124 corresponds to the through mode.

Figure 2:
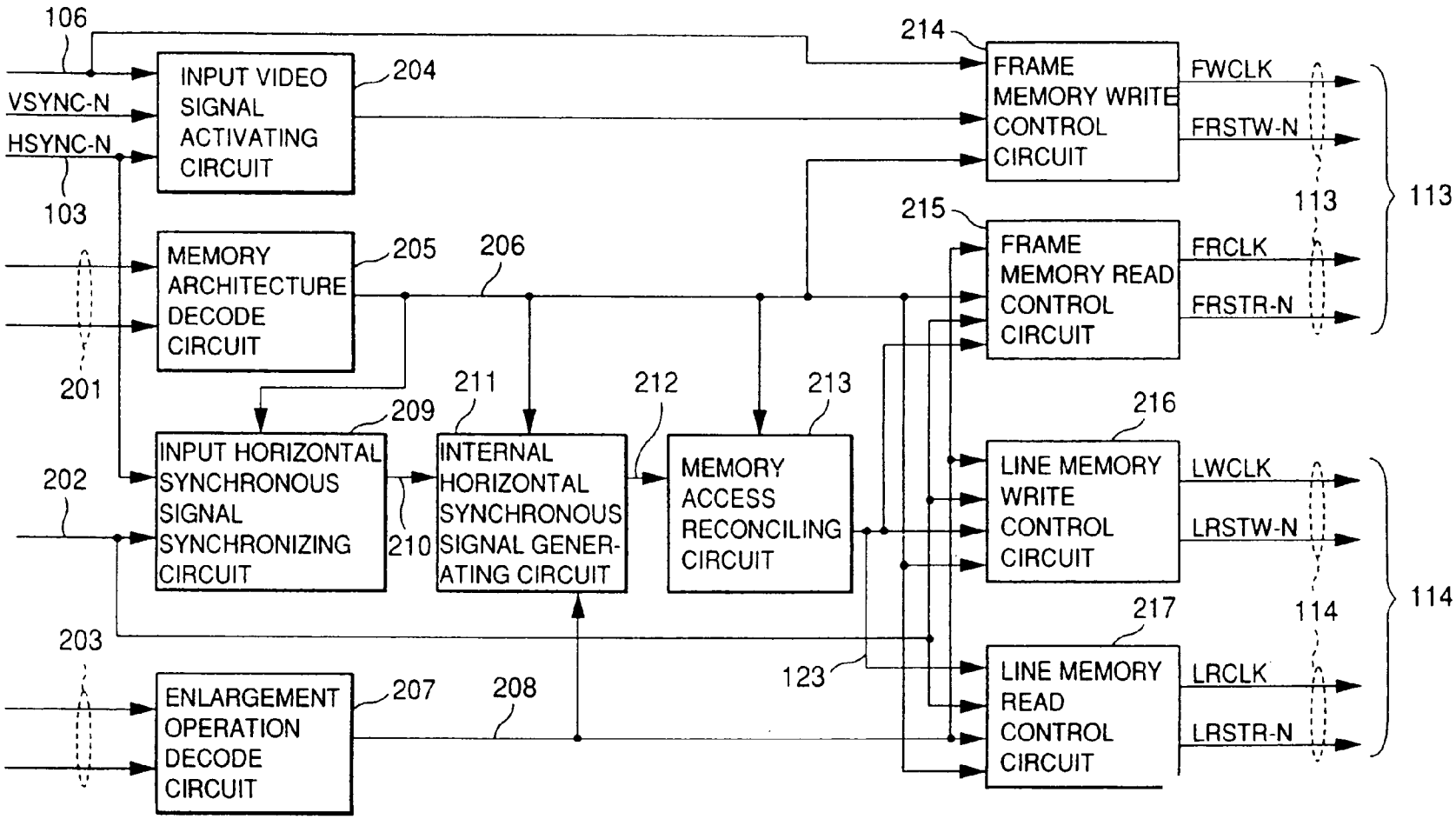
FIG. 2 is a block diagram showing an internal construction of a frame/line memory control circuit 112 and a memory access reconciling signal generator 213 of a display timing generating circuit 120.

The synchronizing circuit 209 in FIG. 2 synchronizes the input horizontal synchronous signal 103 and a reference clock 202 which serves as a reference for the display timing, and then outputs as an input horizontal synchronous signal 210 to the internal horizontal synchronous signal generating circuit 211. The reference clock 202 is input from a clock which is provided at the outside of the frame/line memory control circuit 112.

The internal horizontal synchronous signal generating circuit 211 synthesizes the input horizontal synchronous signal 210 and an internal horizontal synchronous signal produced therein, and then outputs the synthesized signal as an output horizontal synchronous signal 212 to the memory access reconciling circuit 213.

The memory access reconciling circuit 213 serves to adjust the access timing to the frame memory 110 and the line memory 111. The memory access reconciling signal 123 which is output from the memory access reconciling circuit 213 is used to determine a method for accessing the frame memory 110 and the line memory 111 when the display of each of the through mode, the gradation integration mode and the simple enlargement mode is performed in accordance with the memory architecture of the mode signal 201 and the calculation mode signal 203.

Figure 6:
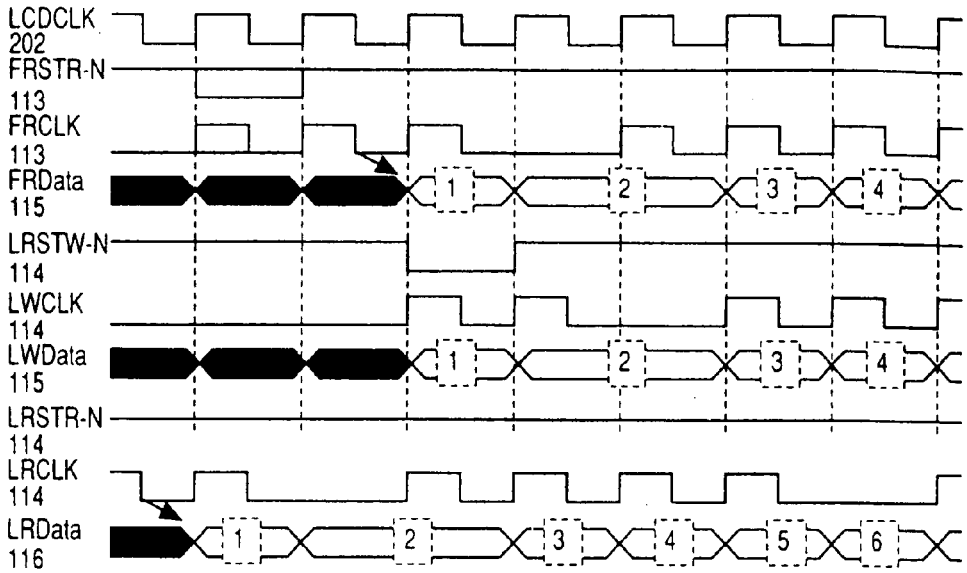
FIG. 6 is a timing chart showing the operation under 4→5 enlargement based on the gradation integration method.
Figure 6:
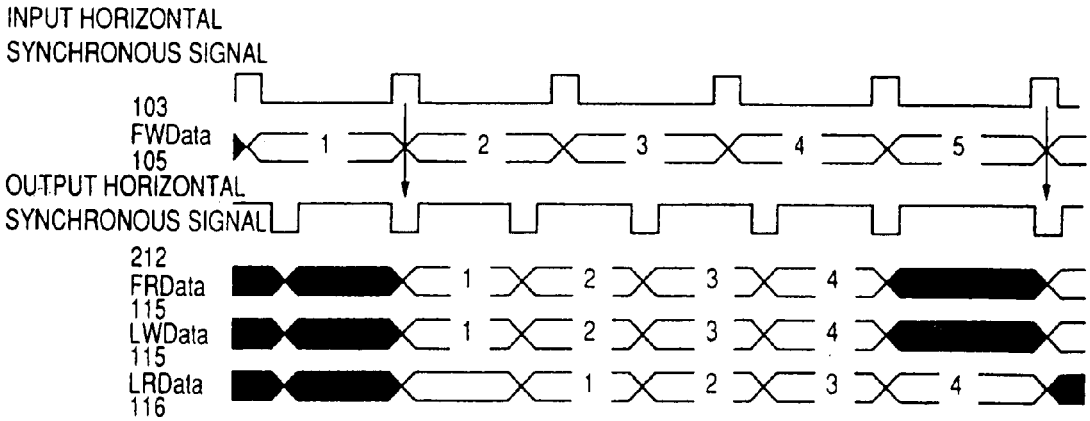
Figure 7:
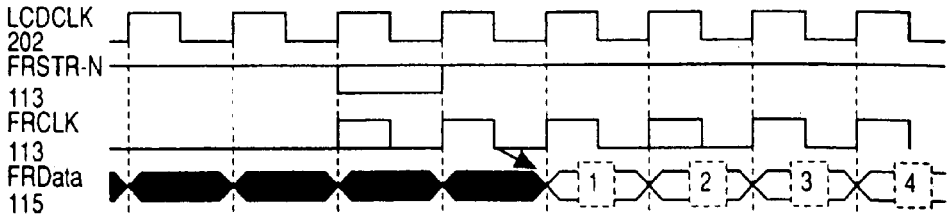
FIG. 7 is a timing chart showing the operation of a through mode when a memory is used.
Figure 7:
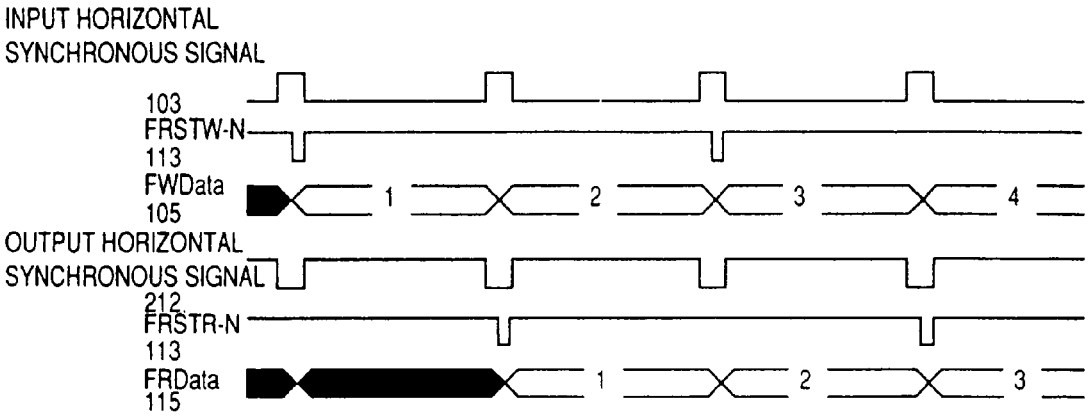

Specifically, it is used to select an operation sequence shown in a horizontal-direction memory access timing chart in FIGS. 5 to 7 (FIGS. 9 and 10 in a second embodiment as described later). The memory access reconciling circuit 213 is actually contained in the display timing generating circuit 120 shown in FIG. 1.

The frame memory write control circuit 214 and the frame memory read control circuit 215 serves to control the frame memory 110. The line memory write control circuit 216 and the line memory read control circuit 217 serve to control the line memory 111.

Although not shown in FIG. 2, the resolution judgment signal 108 is input to each element of FIG. 2. The frame/line memory control circuit 112 and the display timing generating circuit 120 are designed to switch the operation of FIGS. 5 to 7 (FIGS. 9 and 10 in the second embodiment described later) in accordance with the value of the resolution judgment signal 108.

Next, the enlargement processing operation of the frame/line memory control circuit 112, etc. will be described with reference to FIGS. 5 to 7.

Figure 5:
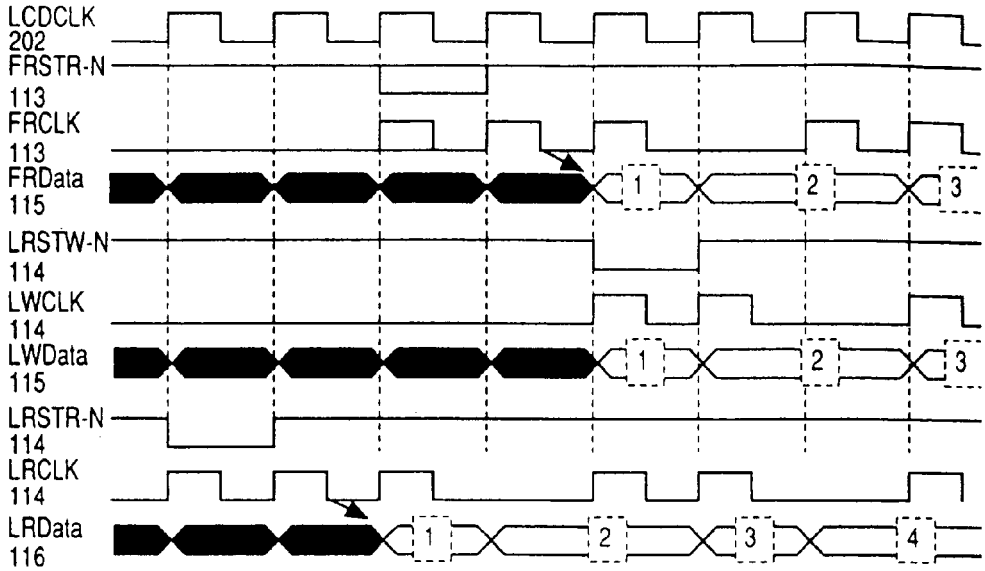
FIG. 5 is a timing chart showing the operation under 2→3 enlargement based on the gradation integration method.
Figure 5:
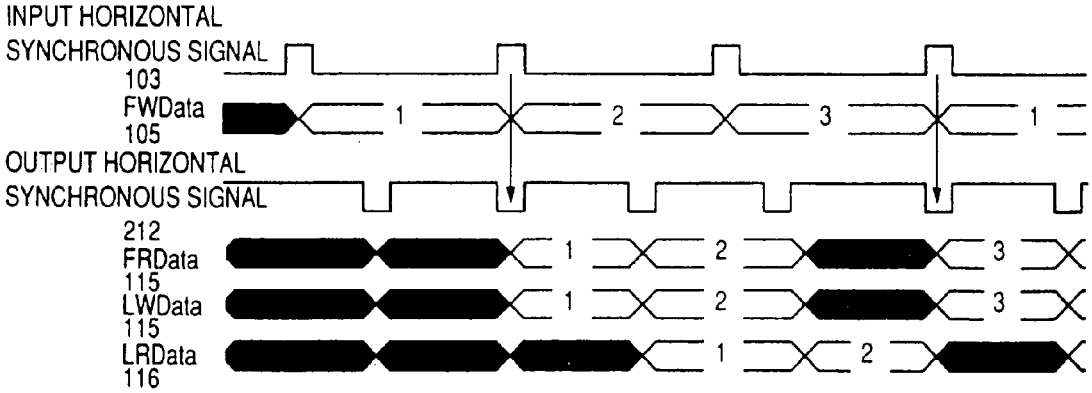

FIG. 5 is a timing chart showing the 2→3 enlargement (gradation integration method) operation of the frame/line memory control circuit 112. FIG. 6 is a timing chart showing the 4→5 enlargement (gradation integration method) operation. FIG. 7 is a timing chart showing the through-mode operation when the memory is used.

The input video signal activating circuit 204 activate the frame memory write control circuit 214 at a predetermined timing which is determined on the basis of the synchronous signal (VSYNC-N/HSYNC-N) 103 and the dot clock 106.

The activated frame memory write control circuit 214 generates a write signal (clock: FWCLK/write reset:FRSTW-N) of the frame memory 110 on the basis of the decode signal 206 and the dot clock 106. The write signal constitutes a part of the frame memory control signal 113 of FIG. 1. The write operation into the frame memory 110 in accordance with the write signal 113 is performed in synchronism with the horizontal synchronous signal (HSYNC-N) 103 in all the modes shown in FIGS. 5 to 7.

The control content of the frame memory read control circuit 215 is identical to that of the line memory write control circuit 216. This is because in the case of the enlargement processing based on the gradation integration method (see FIGS. 5, 6), the data read out from the frame memory 110 are immediately written into the line memory 111. For example, in the case of FIG. 5, the read-out (FRData 115 ) operation of data from the frame memory 110 and the write-in (LWData 115 ) operation of data into the line memory 111 are performed at the same timing at all times.

The read-out operation of data from the line memory 111 is performed before the write-in cycle (before the time corresponding to two dot clocks in this embodiment) because the write-in operation into the line memory 111 is made possible.

With respect to the vertical direction, the synchronization of the input/output operation is performed at a constant time interval. That is, the input horizontal synchronous signal synchronizing circuit 209 synchronizes the input horizontal synchronous signal (HSYNC-N) 103 and the display timing reference clock 202, and then outputs it as the input horizontal synchronizing signal 210. The internal horizontal synchronous signal generating circuit 211 synthesizes the input horizontal synchronous signal 210 with the internal horizontal synchronous signal produced therein, and then outputs the thus-synthesized signal as an output horizontal synchronous signal 212 to the memory access reconciling circuit 213. In the case of the 2→3 enlargement (gradation integration method), the internal horizontal synchronizing signal generating circuit 211 causes the output horizontal synchronous signal 212 to be synchronized to the input horizontal synchronous signal (HSYNC-N) 103 every time the input horizontal synchronous signal (HSYNC-N) 103 is output twice. After the synchronization, it generates the output horizontal synchronous signal 212 twice until the next synchronization is started (see FIG. 5).

On the other hand, in the case of the 4→5 enlargement (gradation integration method), the internal horizontal synchronous signal generating circuit 211 synchronizes the output horizontal synchronous signal 212 every time the input horizontal synchronous signal (HSYNC-N) 103 is output four times. After the synchronization, it generates the output horizontal synchronous signal 212 four times until the next synchronization is started (see FIG. 6). The switching operation of the processing in accordance with the magnification as described above is performed on the basis of the decode signal 208.

The memory access reconciling circuit 213 generates the memory access reconciling signal 123 on the basis of the output horizontal synchronous signal 212, and outputs the signal 123 to the frame memory read control circuit 215, the line memory write control circuit 216 and the line memory read control circuit 217.

The frame memory read control circuit 215, the line memory write control circuit 216 and the line memory read control circuit 217 are supplied with the memory architecture decode signal 206, the enlargement calculation decode signal 208 and the reference clock 202 as well as the memory access reconciling signal 123. In accordance with these signals 202, 206, 208 and 123, the frame memory read control circuit 215 generates and outputs the frame memory read control signal (clock:FRCLK/read reset: FRSTR-N). The frame memory read control signal constitutes a part of the frame memory control signal 113 of FIG. 1.

Likewise, the line memory write control circuit 216 generates a line memory write control signal (clock : LWCLK/ write reset : LRSTW-N). The line memory write control signal and the line memory read control signal constitute the line memory control signal 114 in FIG. 1.

Since no enlargement is performed in the through mode under the presence of the memory (see FIG. 7), only the frame memory 110 is used. The frame/line memory control circuit 112 generates the output horizontal synchronous signal 212 at the same timing as the input horizontal synchronous signal 103. A frame memory read cycle is repeated with a delay time corresponding to one line (1 horizontal period) with respect to a frame memory write cycle.

As described above, according to the first aspect of the present invention (FIGS. 1 and 2 ), the enlargement display based on the gradation integration method and the through display using the memory can be performed. Furthermore, the read and write operations of the frame memory 110 are performed in synchronism with each other, so that the FIFO type line buffer having a storage capacity of two lines may be used as the frame memory 110.

When the analog video signal 102 having the same high resolution as the liquid crystal display panel 124 is input, the through display is performed by bypassing the frame memory 110 and the line memory 111. Accordingly, any memory having a processing speed at which a video signal of intermediate resolution or less can be processed may be used as the memories 110 and 111, and thus a cheap and low-speed memory may be used.

Table 4 shows examples of the frame memory 110 and the line memory 111 which are usable for the two-parallel processing under the condition that the resolution of the liquid crystal display panel 124 is equal to 1024×768 (XGA mode), the display processing speed is equal to 30 MHz, and the maximum input operation speed of the video signal having the intermediate resolution is equal to 50 MHz.

TABLE 4

| TYPE | MAKER | ARCHITECTURE | CYCLE TIME (ns) |
|---|---|---|---|
| HM63021 | HITACHI | 2k*8 bit | 28 |
| uPD485505 | NEC | 5k*8 bit | 25 |

In this case, since the data is assumed to be subjected to the parallel processing, the dot clock is equal to 25 MHz which is a half of the input operation speed of 50 MHz. According to this embodiment, the video signal of high resolution is passed through neither the memory 110 nor the memory 111. Accordingly, the memories 110 and 111 may be designed to be usable for the dot clock 25 MHz. On the other hand, when the present invention is not applied, the video signal of high resolution (XGA mode) must be also passed through the memories 110 and 111, and then subjected to the processing. Therefore, in this case, the input processing speed is increased to 70 MHz, and the dot clock is also increased to 37.5 MHz. In order to match the memory to such a high input processing speed and such a high dot clock, the memory is required to be an expensive and high-speed memory.

Figure 8:
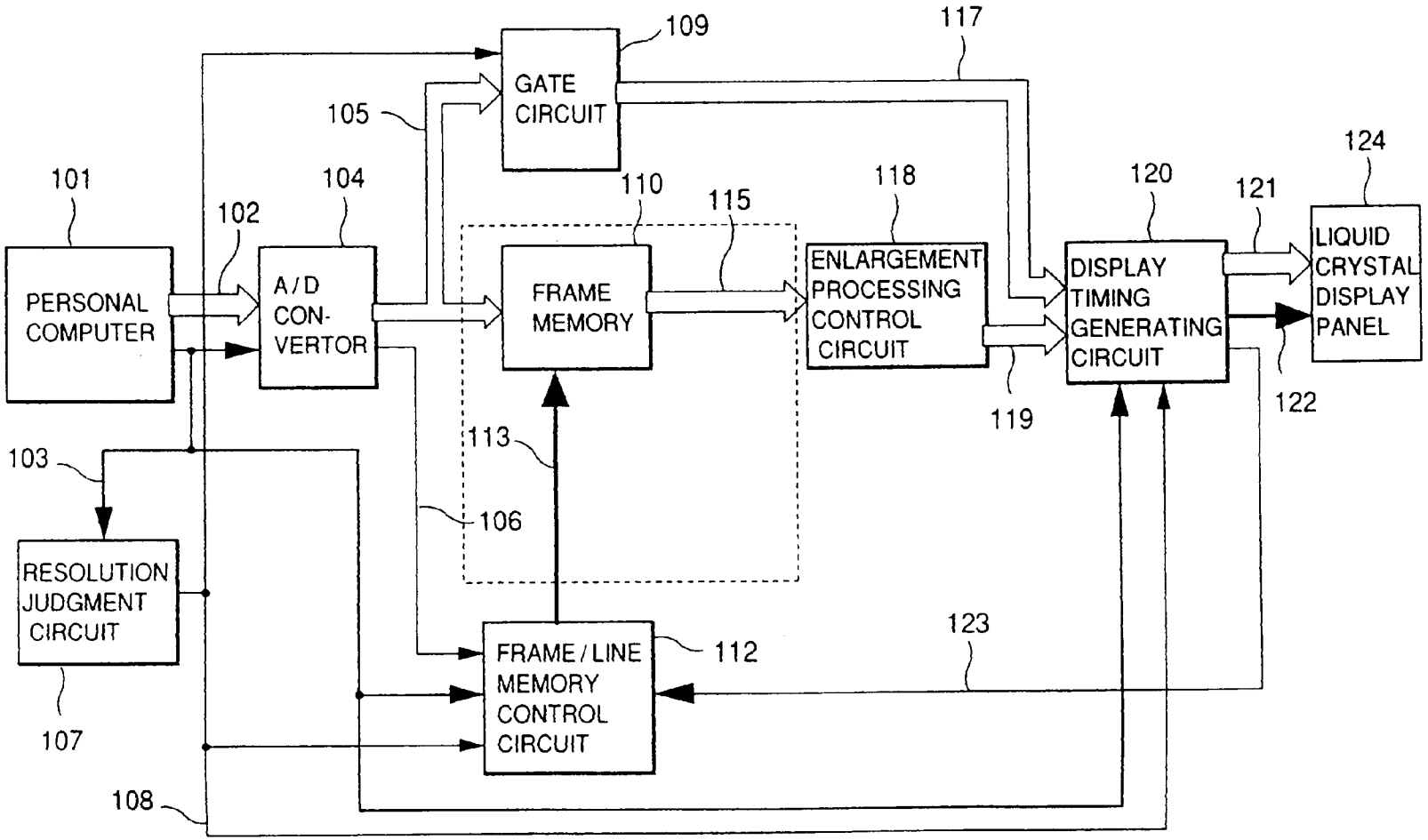
FIG. 8 is a block diagram showing the construction of a liquid crystal display control device according to a second embodiment of the present invention.

Next, a second embodiment according to the present invention will be described with reference to FIG. 8.

The second embodiment of the present invention uses the simple enlargement method (see FIG. 4) as the enlargement processing system. Accordingly, no line memory is mounted. A portion which is surrounded by a broken line in FIG. 8 is a different portion from the first embodiment (see FIG. 1).

Figure 9:
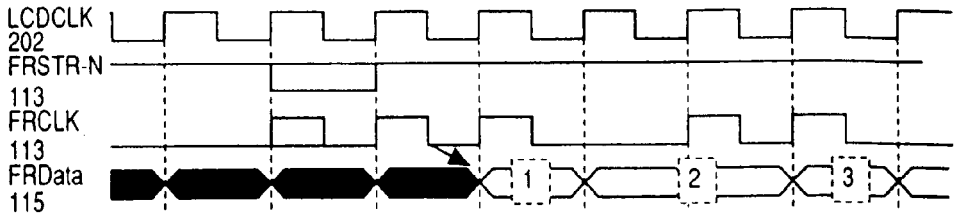
FIG. 9 is a timing chart showing the operation under 2→3 enlargement based on the simple enlargement method.
Figure 9:
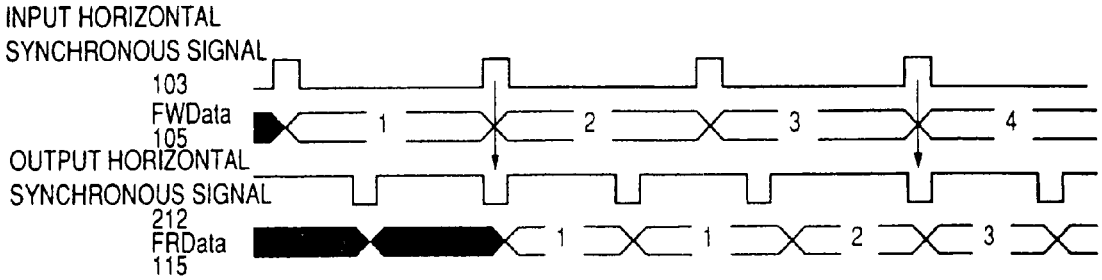
Figure 10:
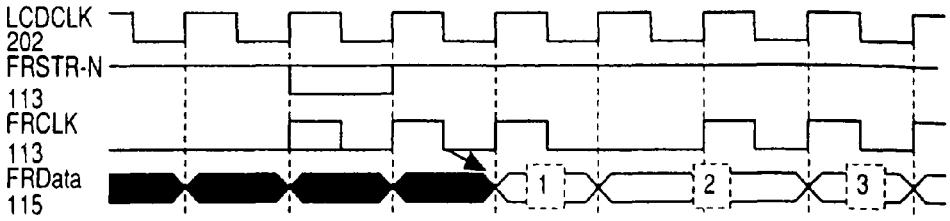
FIG. 10 is a timing chart showing the operation under 4→5 enlargement based on the simple enlargement method.
Figure 10:
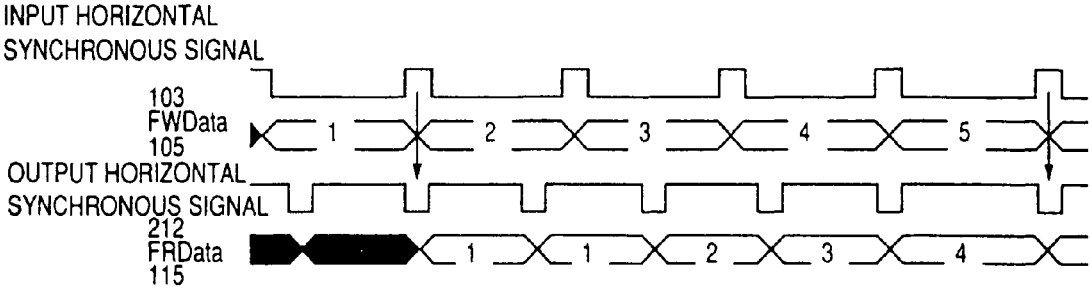

FIGS. 9 and 10 are timing charts for the 2→3 enlargement processing and the 4→5 enlargement processing which are based on the simple enlargement method (see FIG. 4), respectively. The synchronization of the input horizontal synchronous signal by the frame/line memory control circuit 112, the generation of the internal horizontal synchronous signal, etc. are performed in the same manner as the first embodiment. Therefore, the circuit shown in FIG. 2 is directly used in the second embodiment.

The control switching operation of the gradation integration method and the simple enlargement method is performed on the basis of the decode signal 208 which is obtained by decoding the calculation mode signal 203 (see FIG. 2) in the enlargement calculation decode circuit 207.

Both the 2→3 simple enlargement processing and the 4→5 simple enlargement processing are performed by reading the first line from the frame memory 110 twice. Even when the line memory 111 is mounted, the simple enlargement processing can be performed by invalidating the read/write control to the line memory 111.

The liquid crystal display control device as described above can change its enlargement processing content (that is, image quality) in accordance with the presence or absence of the line memory. In this case, no change is required to the control circuit. Accordingly, if the line memory 111 is designed like a memory card and it is allowed to be freely mounted on the device, a user can freely select the enlargement processing method (image quality) in accordance with the application, the cost, etc.

Figure 11:
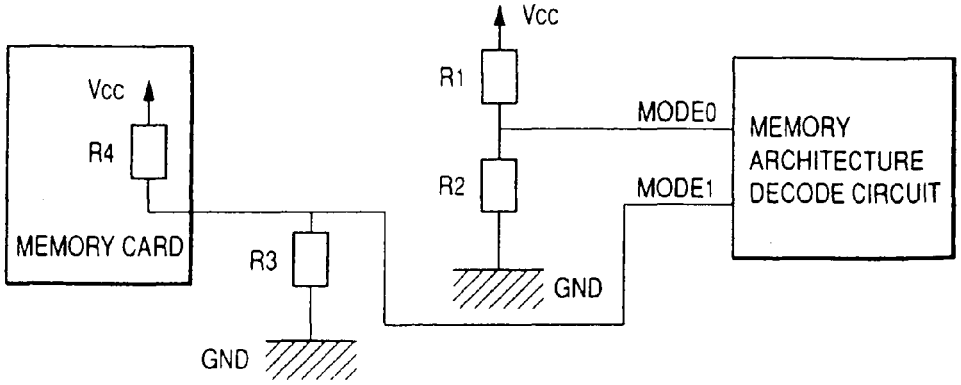
FIG. 11 is a diagram showing a construction for detecting a memory architecture.
Figure 12:
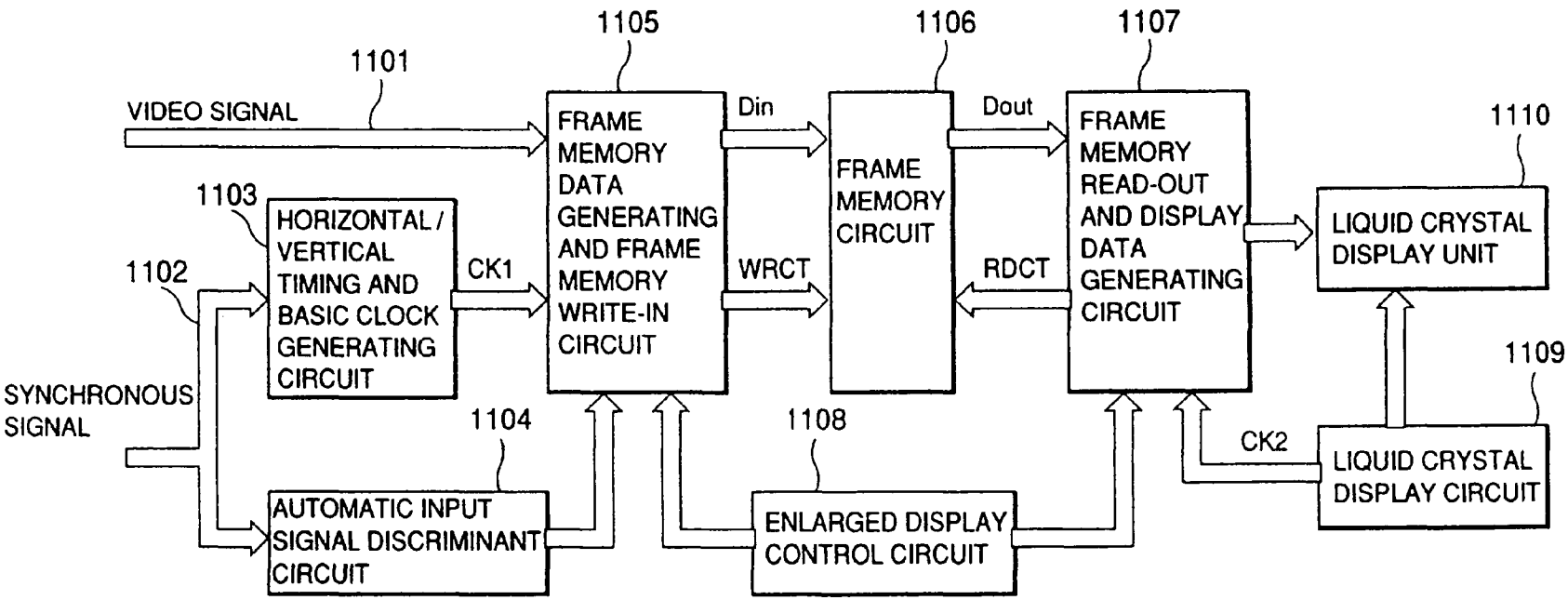
FIG. 12 is a block diagram showing a conventional liquid crystal display device.
Figure 13:
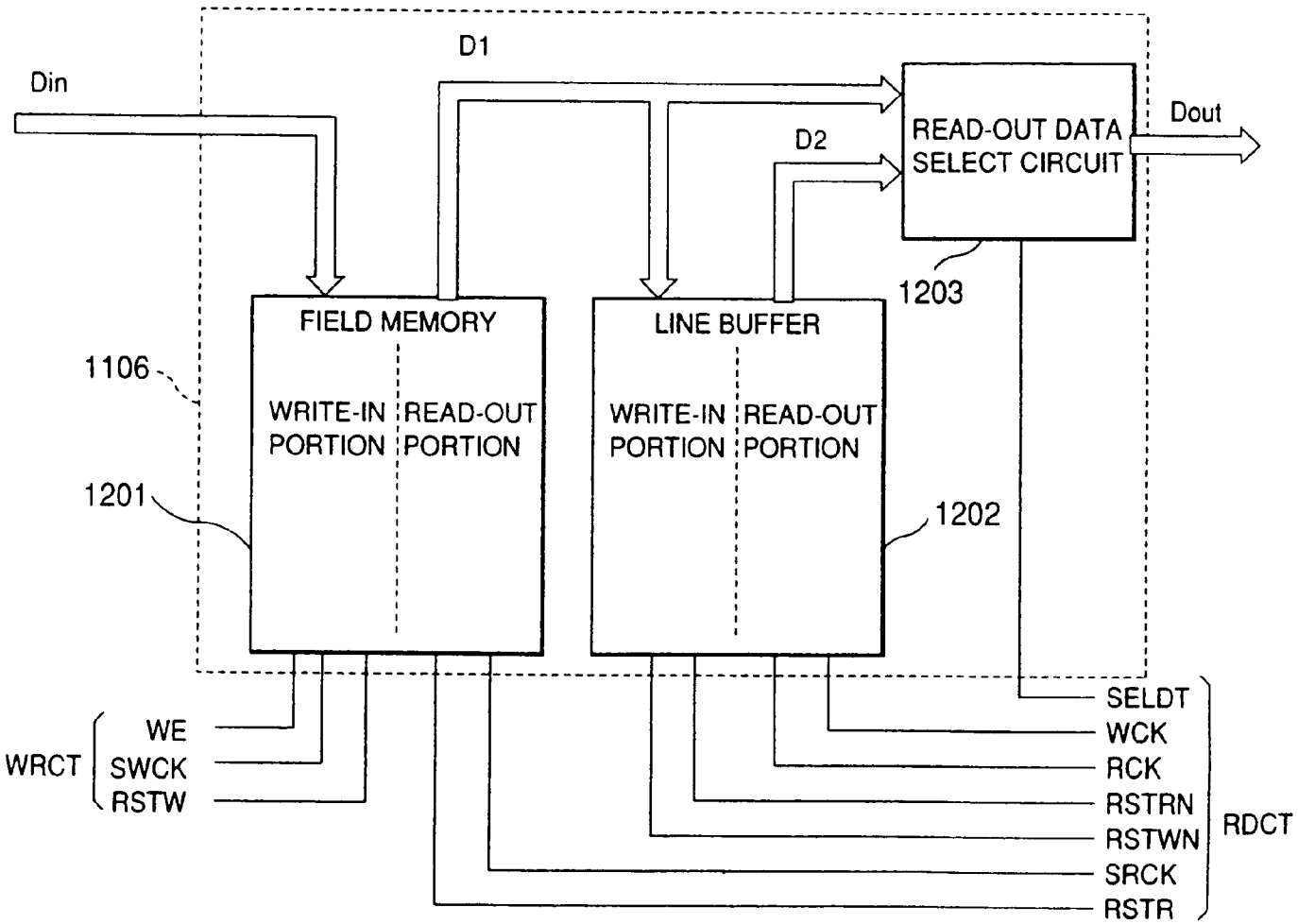
FIG. 13 is a block diagram showing the details of a conventional frame memory circuit.

Detection of the memory architecture when the line memory 111 is designed in the form of a memory card, will be described with reference to table 5 and FIG. 11. In the following description, it is assumed that the mode signal in accordance with the memory architecture is set as shown in the table 5.

TABLE 5

| MODE1 | MODE0 | MEMORY ARCHITECTURE |
|---|---|---|
| L | L | NO |
| L | H | FRAME MEMORY |
| H | H | FRAME/LINE MEMORY |

In the through mode in the absence of the memory, resistors R2 and R3 are mounted, and MODE (1:0) signal is logically set to "L" level. When only the frame memory is mounted and the simple enlargement processing is performed, MODE (1:0) is set to (L,H) by mounting the resistor R1 in place of the resistor R2. Further, when a memory card is mounted as the line memory, one end of a resistor R4 which is mounted on the memory card is connected to a MODE1 terminal, so that the terminal is logically set to "H" level. That is, MODE (1:0) is set to (H,H) level. Accordingly, both the frame memory and the line memory are recognized to be mounted, and the gradation integration processing is allowed.

The "storage means" as described in the claims corresponds to the frame memory 110, the line memory 111 in the above-described embodiments. The "memory control means" corresponds to the frame/line memory control circuit 112, etc. The "calculation processing circuit" corresponds to the enlargement processing circuit 118, etc. The "memory mount portion" corresponds to a slot or the like on which the line memory is mounted. The "resolution judgment means" corresponds to the resolution judgment circuit 107. The "first processing means" corresponds to the gate 109. The "second processing means" corresponds to the frame memory 110, the line memory 111, the enlargement processing circuit 118, etc. The "timing adjusting means" corresponds to the display timing generating circuit 120.

What is claimed is:

1. A liquid crystal display system which enlarges and displays an image represented by video signals, comprising:

a control circuit to input the video signals in accordance with input synchronizing signals and to output the video signals in accordance with output synchronizing signals;

a display panel to display the image represented by the video signals; and a processing circuit to enlarge the image represented by the video signals a non-integer number of times in accordance with a resolution of the display panel divided by a resolution of the image represented by the video signals;

wherein once in every M times the input synchronizing signals are generated and N times the output synchronizing signals are generated, the output synchronizing signals come to correspond to the input synchronizing signals, and wherein the number N is not equal to the number M;

the number N divided by the number M is a non-integer number;

the number N divided by the number M corresponds to the resolution of the display panel divided by the resolution of the image represented by the video signals; and a generation cycle of the output synchronizing signals is almost constant.

2. A liquid crystal display system according to claim 1, wherein a phase difference between the output synchronizing signals and the input synchronizing signals becomes equal once in every M times the input synchronizing signals are generated and N times the output synchronizing signals are generated.

3. A liquid crystal display system according to claim 2, wherein the control circuit includes or is connected to a memory which is able to store the video signals; and the control circuit inputs the video signals to the memory in accordance with the input synchronizing signals and outputs the video signals from the memory in accordance with the output synchronizing signals.

4. A liquid crystal display system according to claim 1, wherein the control circuit includes or is connected to a memory which is able to store the video signals; and the control circuit inputs the video signals to the memory in accordance with the input synchronizing signals and outputs the video signals from the memory in accordance with the output synchronizing signals.

5. A liquid crystal display system according to claim 4, wherein the memory is able to store the video signals for one frame.

6. A liquid crystal display system according to claim 4, wherein the memory is able to store the video signals for two lines.

7. A liquid crystal display system according to claim 4, wherein the processing circuit is connected between the memory and the display panel; and the processing circuit enlarges the image represented by the video signals outputted from the memory the non-integer number of times.

8. A liquid crystal display system according to claim 1, wherein the processing circuit generates data to be inserted into the video signals by a tone integral method.

9. A liquid crystal display system according to claim 1, further comprising a timing generating circuit to generate display timing signals used by the display panel, based on the input synchronizing signals, wherein the timing generating circuit inputs the video signals whose image has been enlarged and outputs to the display panel the video signals whose image has been enlarged together with the display timing signals.

10. A liquid crystal display system according to claim 9, wherein the timing generating circuit comprises a circuit to make the input synchronizing signals correspond to a standard clock; and a generating circuit to generate the output synchronizing signals by synthesizing the input synchronizing signals and internal synchronizing signals generated within the generating circuit.

11. A liquid crystal display system according to claim 1, further comprising a decision circuit to decide the resolution of the image represented by the video signals based on the input synchronizing signals, wherein the processing circuit enlarges the image represented by the video signals the non-integer number of times, using decision results obtained by the decision circuit, in accordance with the resolution of the display panel divided by the resolution of the image represented by the video signals.

12. A liquid crystal display system according to claim 11, further comprising a timing generating circuit to generate display timing signals used by the display panel based on the input synchronizing signals and the decision results obtained by the decision circuit, wherein the timing generating circuit inputs the video signals whose image has been enlarged and outputs to the display panel the video signals whose image has been enlarged together with the display timing signals.

13. A liquid crystal display system according to claim 12, further comprising a bypass circuit to output the video signals to the generating circuit bypassing the processing circuit when the decision results obtained by the decision circuit show that the resolution of the image represented by the video signals coincides with the resolution of the display panel.

14. A liquid crystal display system which enlarges and displays an image represented by video signals, comprising:

a control circuit to input the video signals in accordance with an input timing and to output the video signals in accordance with an output timing;

a display panel to display the image represented by the video signals; and a processing circuit to vertically enlarge the image represented by the video signals a non-integer number of times in accordance with a resolution of the display panel divided by a resolution of an image represented by the video signals;

wherein the output timing corresponds to the input timing at every interval determined in accordance with a resolution of the display panel divided by a resolution of the image represented by the video signals, and wherein the output timing comes at regular intervals.

15. A liquid crystal display system according to claim 14, wherein a phase difference between the output timing and the input timing becomes equal at every interval determined in accordance with the resolution of the display panel divided by the resolution of the image represented by the video signals.

16. A liquid crystal display system according to claim 15, wherein the control circuit includes or is connected to a memory which is able to store the video signals; and the control circuit inputs the video signals to the memory in accordance with the input timing and outputs the video signals from the memory in accordance with the output timing.

17. A liquid crystal display system according to claim 14, wherein the control circuit includes or is connected to a memory which is able to store the video signals; and the control circuit inputs the video signals to the memory in accordance with the input timing and outputs the video signals from the memory in accordance with the output timing.

18. A liquid crystal display system according to claim 17, wherein the memory is able to store the video signals for one frame.

19. A liquid crystal display system according to claim 17, wherein the memory is able to store the video signals for two lines.

20. A liquid crystal display system according to claim 17, wherein the processing circuit is connected between the memory and the display panel; and the processing circuit enlarges video signals outputted from the memory the non-integer number of times.

21. A liquid crystal display system according to claim 14, wherein the processing circuit generates data to be inserted into the video signals by a tone integral method.

22. A liquid crystal display system according to claim 14, comprising:

a timing generating circuit to generate display timing signals used by the display panel, based on the input synchronizing signals wherein the timing generating circuit inputs the video signals whose image has been enlarged and outputs to the display panel the video signals whose image has been enlarged together with the display timing signals.

23. A liquid crystal display system according to claim 22, wherein the timing generating circuit comprises a circuit to make the input synchronizing signals correspond to a standard clock; and a generating circuit to generate the output synchronizing signals by synthesizing the input synchronizing signals and internal synchronizing signals generated within the generating circuit.

24. A liquid crystal display system according to claim 14, further comprising a decision circuit to decide the resolution of the image represented by the video signals based on the input synchronizing signals, wherein the processing circuit enlarges the image represented by the video signals the non-integer number of times, using decision results obtained by the decision circuit, in accordance with the resolution of the display panel divided by the resolution of the image represented by the video signals.

25. A liquid crystal display system according to claim 24, further comprising a timing generating circuit to generate display timing signals used by the display panel based on the input synchronizing signals and the decision results obtained by the decision circuit, wherein the timing generating circuit inputs the video signals whose image has been enlarged and outputs to the display panel the video signals whose image has been enlarged together with the display timing signals.

26. A liquid crystal display system according to claim 25, further comprising a bypass circuit to output the video signals to the generating circuit bypassing the processing circuit when the decision results obtained by the decision circuit show that the resolution of the image represented by the video signals coincides with the resolution of the display panel.

27. A liquid crystal display system which enlarges and displays an image represented by video signals, comprising:

a control circuit to input the video signals in accordance with input synchronizing signals and to output the video signals in accordance with output synchronizing signals;

a display panel to display the image represented by the video signals; and a processing circuit to enlarge the image represented by the video signals a non-integer number of times in accordance with a resolution of the display panel divided by a resolution of the image represented by the video signals;

wherein once in every M times the input synchronizing signals are generated and N times the output synchronizing signals are generated, the output synchronizing signals become corresponding to the input synchronizing signals, and wherein the number N is not equal to the number M;

the number N divided by the number M is a non-integer number:

the number N divided by the number M corresponds to the resolution of the display panel divided by the resolution of the image represented by the video signals; and each period of the output synchronizing signals is the number M divided the number N times of each period of the input synchronizing signals.

28. A liquid crystal display system according to claim 27, wherein a phase difference between the output synchronizing signals and the input synchronizing signals becomes equal once in every M times the input synchronizing signals are generated and N times the output synchronizing signals are generated.

29. A liquid crystal display system according to claim 28, wherein the control circuit includes or is connected to a memory which is able to store the video signals; and the control circuit inputs the video signals to the memory in accordance with the input synchronizing signals and outputs the video signals from the memory in accordance with the output synchronizing signals.

30. A liquid crystal display system according to claim 27, wherein the control circuit includes or is connected to a memory which is able to store the video signals; and the control circuit inputs the video signals to the memory in accordance with the input synchronizing signals and outputs the video signals from the memory in accordance with the output synchronizing signals.

31. A liquid crystal display system according to claim 30, wherein the memory is able to store the video signals for one frame.

32. A liquid crystal display system according to claim 30, wherein the memory is able to store the video signals for two lines.

33. A liquid crystal display system according to claim 30, wherein the processing circuit is connected between the memory and the display panel; and the processing circuit enlarges video signals outputted from the memory the non-integer number of times.

34. A liquid crystal display system according to claim 27, wherein the processing circuit generates data to be inserted into the video signals by a tone integral method.

35. A liquid crystal display system according to claim 27, further comprising a timing generating circuit to generate display timing signals used by the display panel, based on the input synchronizing signals, wherein the timing generating circuit inputs the video signals whose image has been enlarged and outputs to the display panel the video signals whose image has been enlarged together with the display timing signals.

36. A liquid crystal display system according to claim 35, wherein the timing generating circuit comprises a circuit to make the input synchronizing signals correspond to a standard clock; and a generating circuit to generate the output synchronizing signals by synthesizing the input synchronizing signals and internal synchronizing signals generated within the generating circuit.

37. A liquid crystal display system according to claim 27, further comprising a decision circuit to decide the resolution of the image represented by the video signals based on the input synchronizing signals, wherein the processing circuit enlarges the image represented by the video signals the non-integer number of times, using decision results obtained by the decision circuit, in accordance with the resolution of the display panel divided by the resolution of the image represented by the video signals.

38. A liquid crystal display system according to claim 37, further comprising a timing generating circuit to generate display timing signals used by the display panel based on the input synchronizing signals and the decision results obtained by the decision circuit, wherein the timing generating circuit inputs the video signals whose image has been enlarged and outputs to the display panel the video signals whose image has been enlarged together with the display timing signals.

39. A liquid crystal display system according to claim 38, further comprising a bypass circuit to output the video signals to the generating circuit bypassing the processing circuit when the decision results obtained by the decision circuit show that the resolution of the image represented by the video signals coincides with the resolution of the display panel.

* * * * *